United States Patent [19]

Stadlbauer et al.

[11] 3,934,388

[45] Jan. 27, 1976

[54] METHOD AND APPARATUS FOR HANDLING BAGS

[75] Inventors: Wilhelm Stadlbauer, Alkoven; Walter Kump, Linz; Erwin Koller, Ennsdorf, all of Austria

[73] Assignee: Vereinigte Osterreichische Eisen- und Stahlwerke-Alpine Montan Aktiengesellschaft, Linz, Austria

[22] Filed: Nov. 11, 1974

[21] Appl. No.: 522,416

[30] Foreign Application Priority Data

Dec. 4, 1973 Austria ..... 10149/73

[52] U.S. Cl. ..... 53/29; 53/188; 53/386

[51] Int. Cl.[2] ..... B65B 43/30

[58] Field of Search ..... 53/386, 188, 29

[56] References Cited

UNITED STATES PATENTS

| | | | |
|---|---|---|---|
| 2,684,191 | 7/1954 | Dolman | 53/386 X |
| 3,844,092 | 10/1974 | Stringer et al. | 53/188 |

*Primary Examiner*—Travis S. McGehee
*Attorney, Agent, or Firm*—Kurt Kelman

[57] ABSTRACT

The method serves to handle a bag which is open at one end and has at least one closed edge and is disposed at the top of a stack of bags. A suction device is operated to descend and engage said bag at a closed edge thereof and then to ascend so as to raise said bag adjacent to said closed edge, whereby a gap is formed between said suction device and said stack. A bag support having a leading edge is moved through said gap relative to said closed edge and transversely thereto. Said bag is held in a raised position as said support is thus moved until said bag has been entirely drawn over said leading edge. Said bag is subsequently released and fed to a delivery table disposed adjacent to said bagging pipe. A plurality of suction heads are disposed adjacent to said delivery table to engage said bag on said table on the outside of said bag adjacent to said open end, then to move apart to open said bag at said open end. Said open end is then fitted onto said bagging pipe.

8 Claims, 1 Drawing Figure

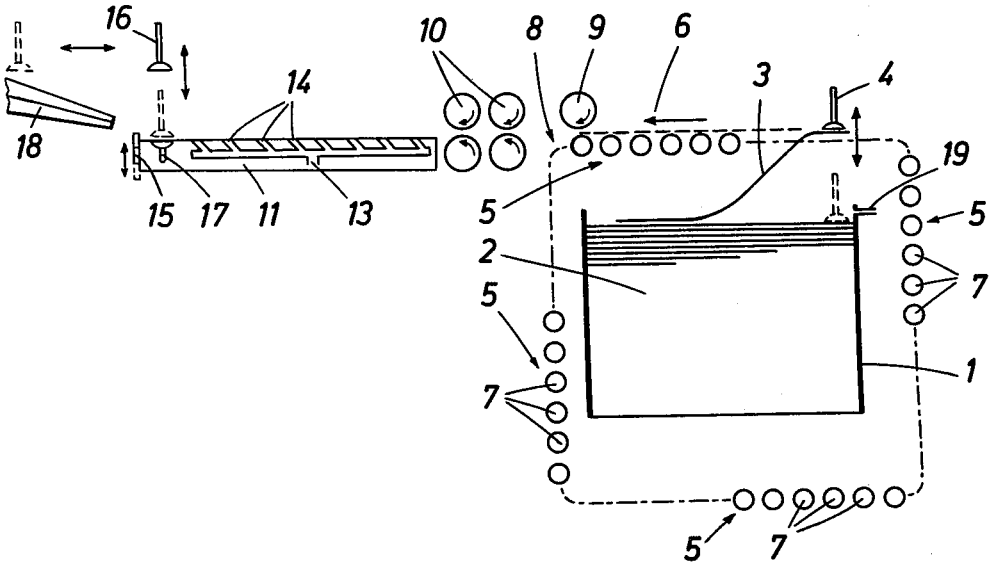
16
18
14
15
17
11
13
10
8
9
6
3
4
19
5
2
5
7
5
7
1
5
7

METHOD AND APPARATUS FOR HANDLING BAGS

This invention relates to a method of removing a bag which is open at one end from a stack of such bags and of fitting the moved bag onto a bagging pipe, in which method the bag which is at the top of the stack is raised adjacent to one end of the bag by means of a vertically reciprocable suction device and, after being fed to the bagging pipe, is opened by means of suction heads which engage the outside of the bag adjacent to the bag opening and are adapted to be moved apart, and to apparatus for carrying out the method.

When it is desired to package heavy materials in bags by machine, these bags must be removed from a stack and be fitted onto a bagging pipe. These operations are often performed by hand because it is difficult to separate single bags from a stack at a high rate by machine.

In a known apparatus for removing a bag which is open at one end from a stack of such bags, the bag which is at the top of the stack is raised by means of a suction device which is pivotally movable into engagement with the bag, and the bag is subsequently moved by the laterally displaceable suction device to another suction device, which engages the bag on the other side thereof. The two suction devices are then moved apart to open the bag opening, into which a bagging pipe is introduced, by means of which the bag is fed to a chute. Because the bags are engaged adjacent to the opening thereof, the bag cannot be removed from the stack satisfactorily because there is always the danger that the bag may open and cannot be properly engaged by the second suction device. Besides, the feeding of the bags by means of the suction device requires a rather complicated control system and a high bag feed rate cannot be achieved because the suction device must be returned after each stroke.

Similar difficulties have been encountered in connection with another known apparatus, in which the individual bags are not raised from the stack by the suction device but are only held in position by the latter whereas the stack carrier is lowered so that the same bag-lifting effect is achieved. By a pivotal movement of the suction device, the bag which has been removed is then carried further to the bagging pipe and is opened there by two mutually opposite suction devices. For this reason such apparatus too cannot ensure the satisfactory and fast transportation of the bags removed from the stack.

Finally, an apparatus has been disclosed which serves to remove sheets of paper from a stack. For this purpose, a suction device is lowered onto the stack and is then used to raise the uppermost sheet of paper adjacent to one edge thereof. Air is then blown between the stack and the raised edge of the sheet so that the latter is blown up from the stack. An additional feeding movement in the direction of the entraining air stream is subsequently performed by the suction device to cause the sheet to be drawn into the nip between two rolls and to be fed further on a conveyor belt. In that known apparatus too, the suction device must be returned to its initial position before it can be lowered again so that the sheets cannot be removed at a high rate. Besides, the introduction of the uppermost element of the stack into the nip between two feed rolls can be reliably ensured only with relatively small sheets of paper because, in the handling of relatively large bags or the like, the air stream cannot ensure a flat leading edge to be introduced between the feed rollers.

It is an object of the invention to provide a method by means of which the bags required to package heavy material can be individually removed from a stack of bags and fitted on a bagging pipe by machine at a high rate and without trouble.

In a method of the kind described first hereinbefore, this object is accomplished according to the invention by raising the bag adjacent to a closed edge, preferably the edge which is opposite to the bag opening, and retaining the raised bag edge until the entire bag has been drawn over the leading edge of a support, which is moved through the gap formed between the raised suction device and the stack in a transverse movement relative to the raised edge. Because the uppermost bag of the stack is sucked up adjacent to a closed edge of the bag, the bag cannot open as it is raised. This fact ensures a satisfactory feeding of the bag, which is raised into a feeding plane as it is engaged from below by a moving support. As soon as the entire bag has been drawn over the leading edge of the support, which is displaced relative to the suction device as the support is engaged with the bag, i.e., as soon as the entire bag is on its feeding level, the bag is released by the suction device and can be fed to a delivery table, where it is opened and fitted onto the bagging pipe by means of suction heads which engage the bag and are movable apart. The control of this movement is simple because the bag is lifted and retained only by suction which can be controlled in a simple manner by valves.

For a proper fitting of the bag onto the bagging pipe, the bag must be moved to a predetermined position on the receiving table. To enable each bag to be fed to this position on the delivery table, it is a feature of the invention that air is blown through the delivery table against the underside of each bag. This air forms a carrying cushion on which the bag can slide to a stop. The sliding movement of each bag can be promoted in a simple manner by blowing the air at an angle of about 45° to the feeding direction.

Whereas the support could be reciprocated between the stack and the suction device, it is more desirable to provide, in accordance with the invention, at least two supports which are moved in a spaced apart relation in an orbit, in an arrangement in which the suction device is adapted to be lowered toward the stack of bags and to be raised through each space between two supports. This arrangement substantially reduces the structural expenditure of the feeding mechanism and enables a much higher bag feed rate.

The same purpose is served by another feature of the invention according to which the orbit is disposed in a vertical rather than a horizontal plane so that the orbit encloses the stack of bags.

The supports can be provided in various forms. It will be particularly desirable to provide supports which consist each of a plurality of freely rotatably mounted, parallel rollers, which are arranged one behind the other because in that case the friction between the bags and the rollers can be much reduced.

The freely rotatable supporting rollers enable also the provision of a feed roller which is disposed above the supporting rollers closely before means for downwardly deflecting the supports and which is adapted to receive the bags coming from the stack and to feed them independently of the speed of travel of the supports. A higher feeding speed enables also a higher bag feed rate.

If the distance of the feeding roller from the suction device corresponds to the dimension of the bag in this direction, the bag which has just been removed from the stack is moved adjacent to the feed roller immediately after the release of the bag from the suction device and the feeding of the bag can then be continued at high speed. For this reason, the next bag can be removed from the bag immediately. It will be understood that in this case the length of each support must be less than the length of each bag.

To ensure that only one bag is removed from the stack at a time and another bag cannot be held to the bag by an electrostatic charge or by adhesion, it is another feature of the invention that at least one blast nozzle is provided, which is disposed above the stack and arranged to be directed toward that bag edge which is being sucked. The action of this blast nozzle ensures that any bags which are held to the sucked bag will be detached and fall back onto the stack.

According to a further feature of the invention, the suction device may consist of a plurality of suction heads which are disposed one beside the other. Compared to a continuous slot nozzle, this has the advantage that less suction power is required.

For the same purpose, two groups of suction heads which are arranged one beside the other can be provided to open the bags, one of which groups is fixed in the delivery table whereas the other group is adapted to be raised and lowered and is movable against the bagging pipe in a direction which is parallel to the plane of the table. For this reason, the movable group of suction heads may be used not only to open the bag but also to fit it onto the bagging pipe.

Finally, to ensure that the bags which have been individually taken from the stack come to rest on the delivery table exactly in a predetermined position, it is a feature of the invention that the delivery table is provided with nozzles which are connected to a compressed-air conduit and directed toward the underside of the bag and which are adapted to blow in a direction which is inclined to the feeding direction of the bags, and that a stop is provided which is adapted to be lowered below the plane of the table. The resulting air cushion which moves in the direction of travel ensures that the bags which reach the delivery table are reliably moved to the stop. The stop must be lowered, however, when the bag has been opened and is moved over the table against the bagging pipe. Obviously, the group of suction heads which are mounted on the table must be supplied with air during this operation so that these heads release the bag.

An embodiment of an apparatus for carrying out the method according to the invention is shown diagrammatically and by way of example in the accompanying drawing.

A supply of bags is held in the form of a stack 2 in a bag magazine 1. The bag 3 which is at the top of the stack is raised adjacent to a closed bag edge by a suction device 4 which can be lifted and lowered and which moves the bag approximately to the position shown in solid lines. The suction device 4 consists of a plurality of suction heads disposed one beside the other and is shown in its lower position in dotted lines on the drawing.

The raised closed edge of bag 3 is retained by the suction device 4 until the bag has been entirely engaged from below by one of a plurality of supports 5 to assume the position shown in broken lines. The supports 5 are spaced apart and moved in an orbit around the stack of bags. As the bag 3 is engaged from below, it is pulled over the leading edge of the support which is moved in the direction of the arrow 6. To minimize the friction between the bag 3 and the support 5, each support 5 consists of a plurality of freely rotatable, parallel rollers 7 which are arranged one behind the other.

Feed roll 9 is mounted immediately before point 8 where the supports 5 are downwardly deflected and cooperates with rollers 7 of supports 5 to entrain bag 3 after it has been released from suction device 4, the released bag being moved by feed rolls 10 to a delivery table 11 which contains nozzles 14 which are connected to a compressed-air conduit 13 and directed toward the underside of the bag. On the air cushion produced by the nozzles 14, the bag slides to a stop 15 at the end of the delivery table 11. When the bag has reached the position defined by stop 15, a group of suction heads 16 arranged one beside the other are lowered from above to the bag adjacent to its opening. A second group of suction heads 17 are disposed opposite to the suction heads 16 and act against the underside of the bag. When the bag has been sucked by the suction heads 16 and 17, the suction heads 16 are raised and the bag is opened because the bag portions which contact each other are held to the suction heads 16 and 17 by a negative pressure. To fit the bag which has thus been opened onto the pipe, it is sufficient to lower stop 15 into the position shown in dotted lines, to break the vacuum in the suction heads 17 and to displace the bag against the bagging pipe 18 by means of the suction heads 16. This displacement is indicated by the dotted-line showing of the suction heads 16.

As soon as a bag has been engaged by the feed roll 9 and is fed by the latter to the feed rolls 10, the suction device 4 can be lowered against the stack 2 through the space between two supports 5 and a new bag can be raised. As the bag 3 is raised, another bag may stick to the underside of the raised bag. To enable a detaching of the lower bag from the underside of the raised bag, a blast nozzle 19 is provided, which directs an air jet toward the sucked edge. The air jet from this blast nozzle 19 virtually peels the sticking bag from the sucked bag so that the sticking bag is released and falls down onto the stack 2. It will be understood that the blast nozzle 19 can be supplemented by a plurality of nozzles disposed one beside the other.

The arrangement of the suction heads serving to retain the individual bags or bag portions enables a simple control of the removing and fitting operations. It is sufficient to connect the suction heads by corresponding valves to the suction conduit of a blower in order to ensure that the bag will be held to the suction heads. To release the bag from the suction heads, the latter are shut off from the suction conduit and supplied with air. The valves required for this purpose may be simply electromechanically controlled in known manner.

What is claimed is:

1. A method of handling a bag which is open at one end and has at least one closed edge and is initially disposed at the top of a stack of said bags, which comprises operating a suction device to descend and engage said bag at a closed edge thereof and then to ascend so as to raise said bag adjacent to said closed edge, whereby a gap is formed between said suction device and said stack, moving a bag support having a leading edge through said gap relative to said closed edge and transversely thereto, holding said bag in a raised position as said support is thus moved until said bag has been entirely drawn over said leading edge, subsequently releasing said bag and feeding it to a delivery table disposed adjacent to a bagging pipe, and operating a plurality of suction heads disposed adjacent to said delivery table to engage said bag on said table on the outside of said bag adjacent to said open end and to move apart to open said bag at said open end, and then fitting said open end onto said bagging pipe.

2. A method as set forth in claim 1, in which said closed edge is an end edge opposite to said open end.

3. A method as set forth in claim 1, in which air is blown through said delivery table against the underside of the bag disposed on said table.

4. Apparatus for handling a bag which is open at one end and has at least one closed edge, which comprises a stack carrier adapted to support a stack of said bags, a suction device which is operable to descend and engage a bag at the top of said stack and then to ascend so as to raise said bag adjacent to said closed edge, whereby a gap is formed between said suction device and said stack, at least two supports having a leading edge each and spaced apart in an orbit, each of said supports being movable in said orbit through said gap relative to said closed edge and transversely thereto, said suction device being operable to descend to and ascend from said stack through the space between adjacent ones of said supports and being operable to hold said raised bag in position while one of said supports is thus moved through said gap until said bag has been entirely drawn over said leading edge, and subsequently to release said bag, a bagging pipe, a delivery table adjacent to said bagging pipe, feeding means for feeding said bag onto said delivery table when the bag has been released, and fitting means for fitting a bag disposed on said table onto said pipe, said fitting means comprising a plurality of suction heads disposed adjacent to said delivery table to engage said bag on said table on the outside of said bag adjacent to said open end and then to move apart to open said bag at said open end.

5. Apparatus as set forth in claim 4, in which said orbit is arranged to enclose a stack on said stack carrier.

6. Apparatus as set forth in claim 4, in which each of said supports comprises a plurality of freely rotatable, parallel rollers arranged one behind the other in said orbit.

7. Apparatus as set forth in claim 4, which comprises at least one blast nozzle directed toward said gap.

8. Apparatus for handling a bag which is open at one end and has at least one closed edge, which comprises a stack carrier adapted to support a stack of said bags, a suction device which is operable to descend and engage a bag at the top of said stack and then to ascend so as to raise said bag adjacent to said closed edge, whereby a gap is formed between said suction device and said stack, a bag support having a leading edge and movable through said gap relative to said closed edge and transversely thereto, said suction device being operable to hold said raised bag in position while said support is thus moved through said gap until said bag has been entirely drawn over said leading edge, and subsequently to release said bag, a bagging pipe, a delivery table adjacent to said bagging pipe, feeding means for feeding said bag onto said delivery table when the bag has thus been released, fitting means for fitting a bag disposed on said table onto a pipe, said fitting means comprising a plurality of suction heads disposed adjacent to said delivery table to engage said bag on said table on the outside of said bag adjacent to said open end thereof and then to move apart to open said bag at said open end, a compressed air pipe, a plurality of nozzles connected to said pipe and mounted in said table and adapted to direct air jets against the underside of a bag lying on said table, said jets having a direction which is inclined to the direction in which said bag has been fed onto said table, and a stop which is movable between an upper position in which it projects upwardly from said table to limit the feeding of each bag onto said table, and a lower position in which said stop is disposed below the top of said table.

* * * * *